US009358420B2

(12) United States Patent
Funk et al.

(10) Patent No.: US 9,358,420 B2
(45) Date of Patent: Jun. 7, 2016

(54) PORTABLE EXERCISE DEVICE PROVIDING CONSTANT FORCE OUTPUT

(71) Applicants: Nathan W. Funk, Olmsted Falls, OH (US); Justin H. Funk, Lakewood, OH (US)

(72) Inventors: Nathan W. Funk, Olmsted Falls, OH (US); Justin H. Funk, Lakewood, OH (US)

(73) Assignee: Funk Engineering LLC, Olmsted Falls, OH (US)

( * ) Notice: Subject to any disclaimer, the term of this patent is extended or adjusted under 35 U.S.C. 154(b) by 143 days.

(21) Appl. No.: 14/215,181

(22) Filed: Mar. 17, 2014

(65) Prior Publication Data

US 2014/0287887 A1 Sep. 25, 2014

Related U.S. Application Data

(60) Provisional application No. 61/787,078, filed on Mar. 15, 2013.

(51) Int. Cl.

| | |
|---|---|
| ***A63B 21/08*** | (2006.01) |
| ***A63B 21/062*** | (2006.01) |
| ***A63B 21/00*** | (2006.01) |
| ***A63B 21/008*** | (2006.01) |
| *A63B 21/02* | (2006.01) |

(52) U.S. Cl.

CPC ..... *A63B 21/159* (2013.01); *A63B 21/00072* (2013.01); *A63B 21/0083* (2013.01); *A63B 21/0087* (2013.01); *A63B 21/151* (2013.01); *A63B 21/154* (2013.01); *A63B 21/4043* (2015.10); *A63B 21/023* (2013.01)

(58) Field of Classification Search

CPC ..... A63B 21/00; A63B 21/00047; A63B 21/008; A63B 21/0083; A63B 21/0087; A63B 21/14; A63B 21/1484; A63B 21/15; A63B 21/153; A63B 21/158; A63B 21/159; A63B 21/055; A63B 21/0552; A63B 21/0555; A63B 21/055714

USPC ..... 482/92–94, 97–103

See application file for complete search history.

(56) References Cited

U.S. PATENT DOCUMENTS

| | | | | | |
|---|---|---|---|---|---|
| 3,858,873 | A * | 1/1975 | Jones | A63B 21/0615 | 482/137 |
| 3,912,261 | A * | 10/1975 | Lambert, Sr. | A63B 21/06 | 482/100 |
| 4,811,944 | A * | 3/1989 | Hoff | A63B 23/129 | 482/139 |
| 5,356,360 | A * | 10/1994 | Johns | A63B 21/155 | 482/100 |
| 6,036,622 | A * | 3/2000 | Gordon | A63B 21/154 | 482/51 |

(Continued)

*Primary Examiner* — Stephen Crow
*Assistant Examiner* — Garrett Atkinson
(74) *Attorney, Agent, or Firm* — Standley Law Group LLP

(57) ABSTRACT

The exemplary embodiments herein provide an exercise device having a frame, comprising a first and a second arm, a first end of each arm meeting in fixed angular relationship at a vertex and a second end of each arm extending away from the vertex; a lever arm, having a first and a second end, the first end constrained to rotate about a pin located near the vertex; and a resistance arrangement, configured to convert rotation by a user of a first rotational assembly about an axis on the second end of the first arm into rotation of a second rotational assembly about an axis on the second end of the lever arm, which is converted into rotation of a third rotational assembly about an axis on the second end of the second arm, with the rotation of the third rotational assembly being resisted by a resistive element, the resistance arrangement providing a substantially constant resistance against the rotation of the first rotational assembly by the user over the entire range of the rotation.

11 Claims, 6 Drawing Sheets

(56) References Cited

U.S. PATENT DOCUMENTS 7,645,215 B2 * 1/2010 Gordon ..... A63B 22/0017 482/51
7,833,134 B2 * 11/2010 Gordon ..... A63B 22/0017 482/51
8,517,899 B2 * 8/2013 Zhou ..... A63B 69/182 482/138
2007/0037667 A1 * 2/2007 Gordon ..... A63B 22/0017 482/51
2008/0132391 A1 * 6/2008 Edeker ..... A63B 21/00 482/121
2010/0144496 A1 * 6/2010 Schmidt ..... A63B 21/012 482/70
2010/0152001 A1 * 6/2010 Gordon ..... A63B 22/0017 482/53

* cited by examiner

PORTABLE EXERCISE DEVICE PROVIDING CONSTANT FORCE OUTPUT

CROSS-REFERENCE TO RELATED APPLICATIONS

This application is a non-provisional of U.S. 61/787,078, filed on 15 Mar. 2013, which is incorporated by reference as if fully recited herein.

TECHNICAL FIELD

The disclosed embodiments generally relate to compact devices that use the mechanical advantages of pulleys and cams.

BACKGROUND OF THE ART

The benefits of a consistent exercise regimen have been well documented. It is now well accepted that exercising provides a number of health advantages, both in long term effects of preventing disease and in the short term effects of mental awareness, relaxation, and stress relief. It is believed that lack of exercise for an extended period of time (especially for those who are accustomed to regular exercise) can result in increased stress, reduced mental awareness, and resulting poor performance.

In some situations however, exercise can be very difficult to perform due to a lack of physical space. These situations seem to occur often during space missions, armed forces service on a vessel such as a submarine, or in a congested environment such as a small apartment in a large city.

SUMMARY OF THE EXEMPLARY EMBODIMENTS

The exemplary embodiments herein provide an exercise device having a frame, comprising a first and a second arm, a first end of each arm meeting in fixed angular relationship at a vertex and a second end of each arm extending away from the vertex; a lever arm, having a first and a second end, the first end constrained to rotate about a pin located near the vertex; and a resistance arrangement, configured to convert rotation by a user of a first rotational assembly about an axis on the second end of the first arm into rotation of a second rotational assembly about an axis on the second end of the lever arm, which is converted into rotation of a third rotational assembly about an axis on the second end of the second arm, with the rotation of the third rotational assembly being resisted by a resistive element, the resistance arrangement providing a substantially constant resistance against the rotation of the first rotational assembly by the user over the entire range of the rotation.

The foregoing and other features and advantages of the present invention will be apparent from the following more detailed description of the particular embodiments, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and wherein.

DETAILED DESCRIPTION

Figure 1:
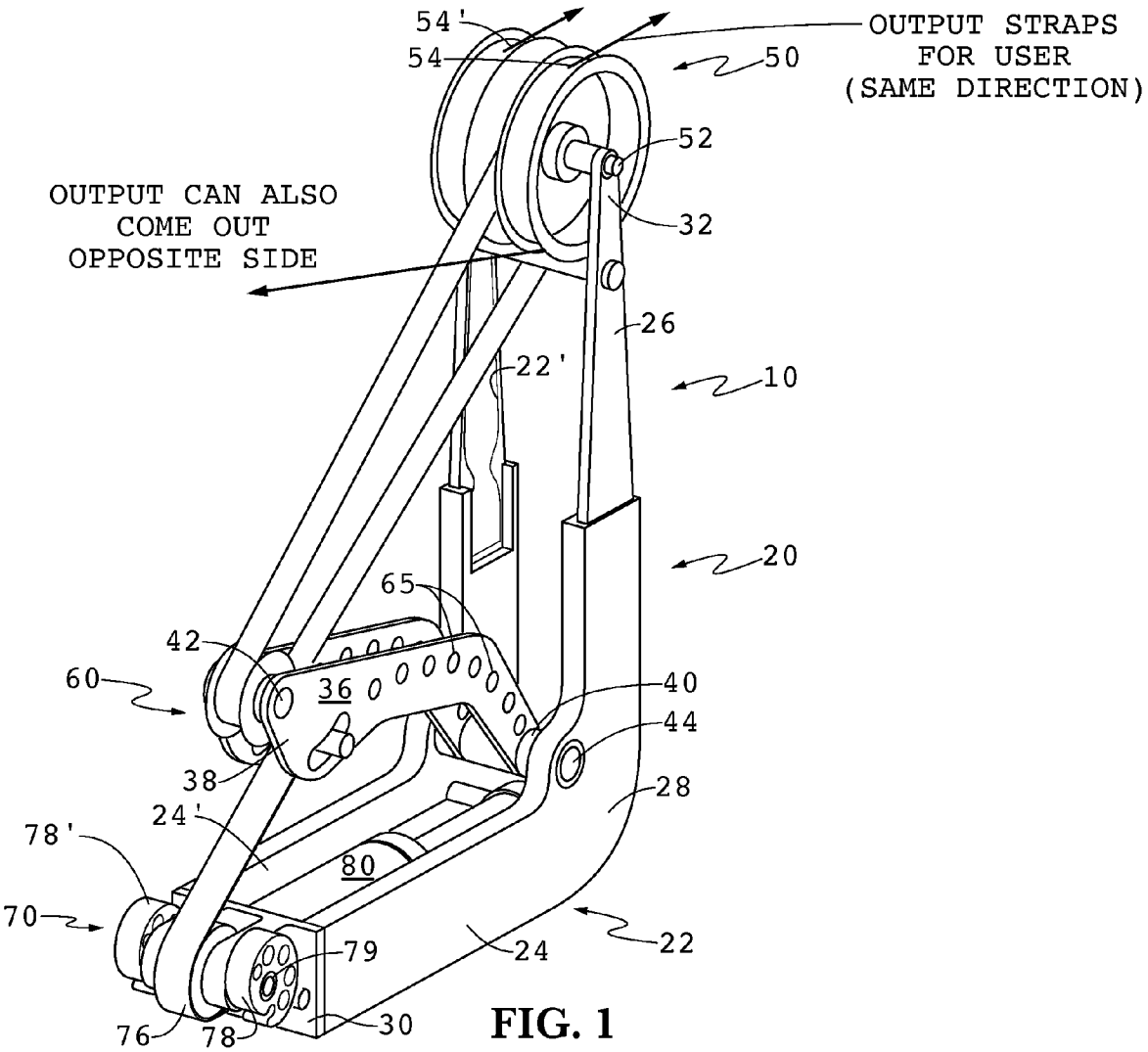
FIG. 1 is a perspective view of a fully-assembled exemplary embodiment of the exercise device.
Figure 2B:
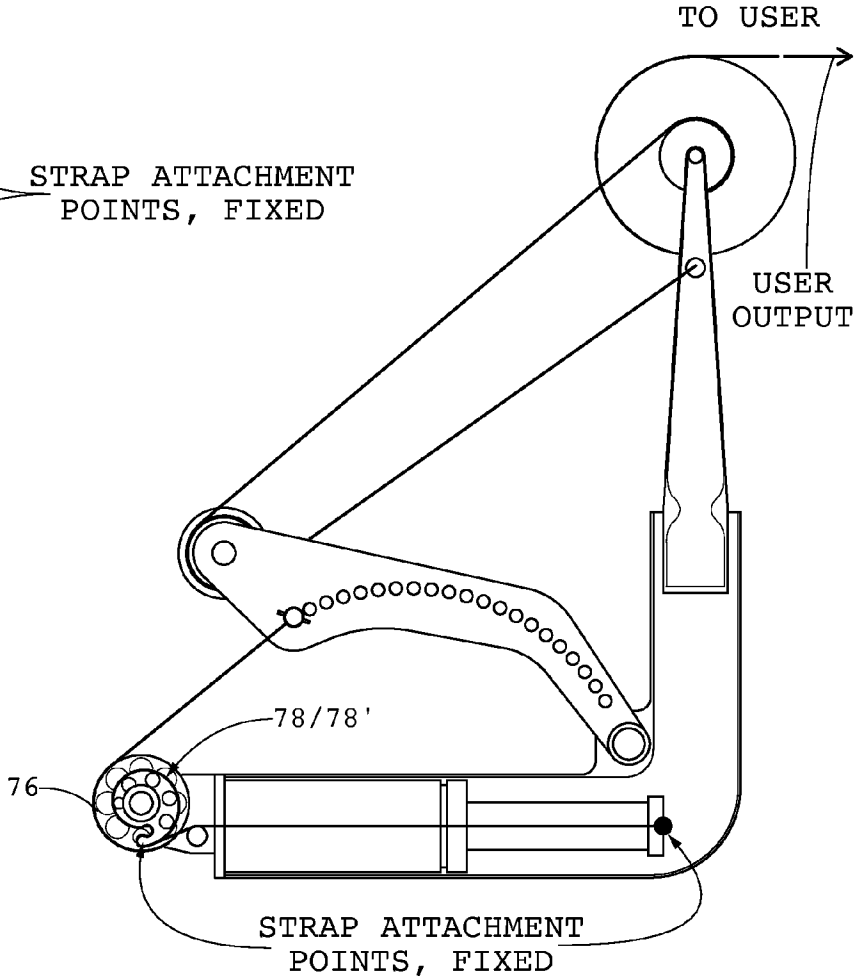
FIGS. 2A-2B are section views of the embodiments of the FIG. 1 embodiment, showing various strap attachment positions as well as approximate gearing.
Figure 2A:
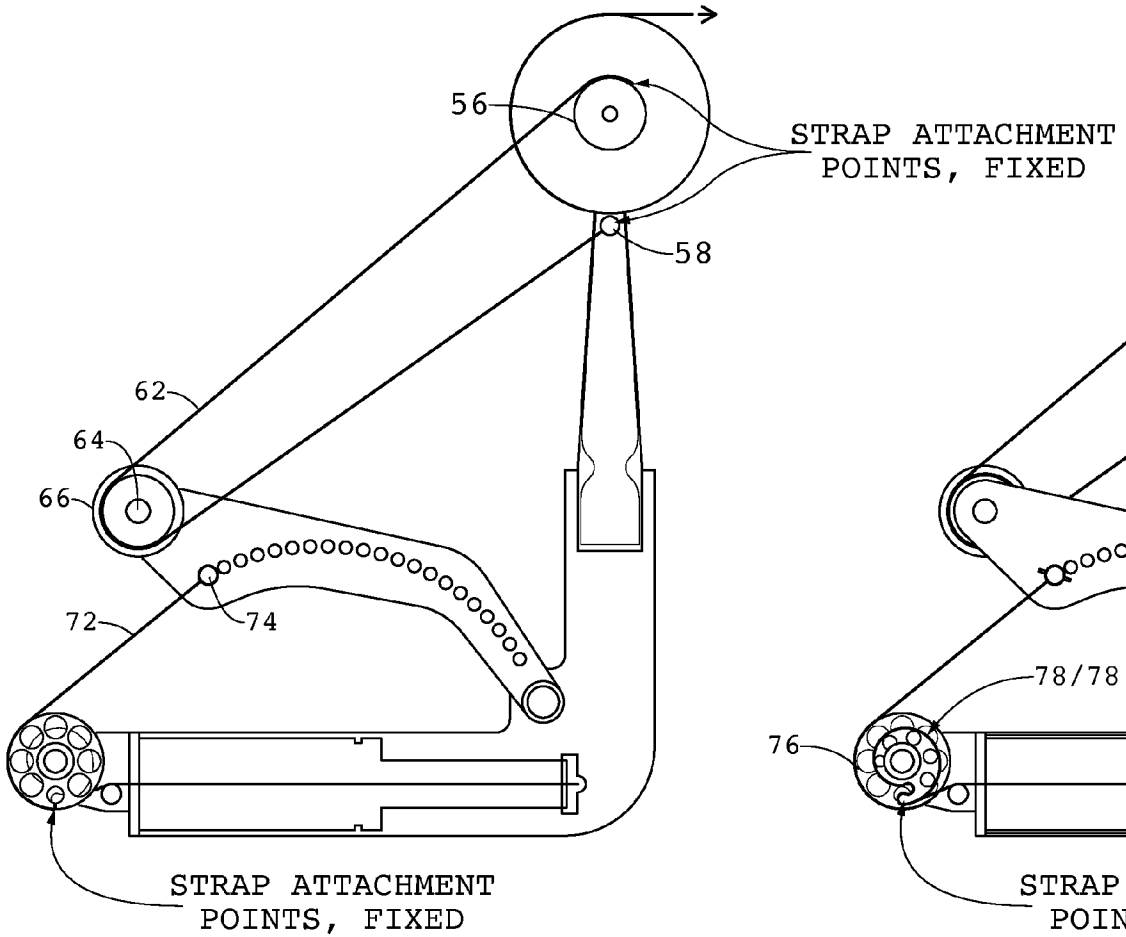

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 shows, in perspective view, a fully assembled embodiment 10 of the exercise device. The embodiment 10 is shown with a frame 20 that has three rotational assemblies 50, 60, 70 and a resistive element 80, the respective rotational assemblies and the resistive element defining a resistive arrangement. In a very broad description of the device, the frame 20 operatively supports the three rotational assemblies 50, 60, 70 in a manner so that rotation of the first rotational assembly 50 by a user is transferred mechanically through the second rotational assembly 60 and the third rotational assembly 70, to the resistive element 80. Because of the manner in which the parts of the embodiment 10 are arranged, the resistance provided to the user at the first rotational assembly is substantially linear and constant.

At least as importantly, a compact resistive element 80 is able to provide this constant resistance over a range of variable resistance, permitting a free weight exercise to be effectively simulated. A large resistance over a very small distance of movement at the resistive element is converted to a lower resistance, but requiring a larger distance of movement. For example, it is within the scope of the device to provide a resistive load at the output with in an adjustable range of between about 30 to about 500 lbs and a displacement of about one meter or more, which will allow multiple exercises including but not limited to: squats, curls, and deadlifts.

Looking at the elements of the embodiment 10 more particularly, it is seen that the frame 20 can be arranged as a pair of frame members 22, 22' which are, in the depicted embodiment, mirror images of each other. As depicted, the frame members 22, 22' are generally "L"-shaped, with each member having a first arm 24, 24' and a second arm 26, 26'. In this "L"-shaped embodiment, a vertex 28 is formed where the first ends of the first arms 24, 24' and the first ends of the second arms 26, 26' join. In many embodiments, these respective first ends are integrally formed or rigidly joined together Each first arm 24, 24' also has a second end 30, 30' and each second arm 26, 26' has a second end 32, 32'. The respective second ends 30, 30', 32, 32' provide sites for locating two of the three rotational assemblies (assemblies 50 and 70), as will be explained.

A further feature of the frame 20 is a lever arm 36, which is depicted as having first and a second members 38, 38', each of which has a first end 40, 40' and a second end 42, 42'. The first ends 40, 40' are constrained to limited rotation about a pin 44 or similar member that provides an axis of rotation. The pin 44 passes between the first and second members 22, 22' of the frame 20 near the vertex 28. The second ends 42, 42' provide a site for locating one of the rotational assemblies (assembly 60), as explained below.

In the depicted embodiment, the frame 20 also provides a cradle into which the resistive element 80 can be arranged. In this embodiment, the resistive element 80 is positioned along the length of (and between) the pair of first arms 24, 24'.

In a preferred arrangement of the embodiment 10, the respective first arms 24, 24' of the frame 20 are each provided in two sections, so that the second arms can be disassembled from transport, as will be explained.

With the understanding of the frame 20 generally established, the interaction of the parts of the resistive arrangement can be explained.

Figure 3:
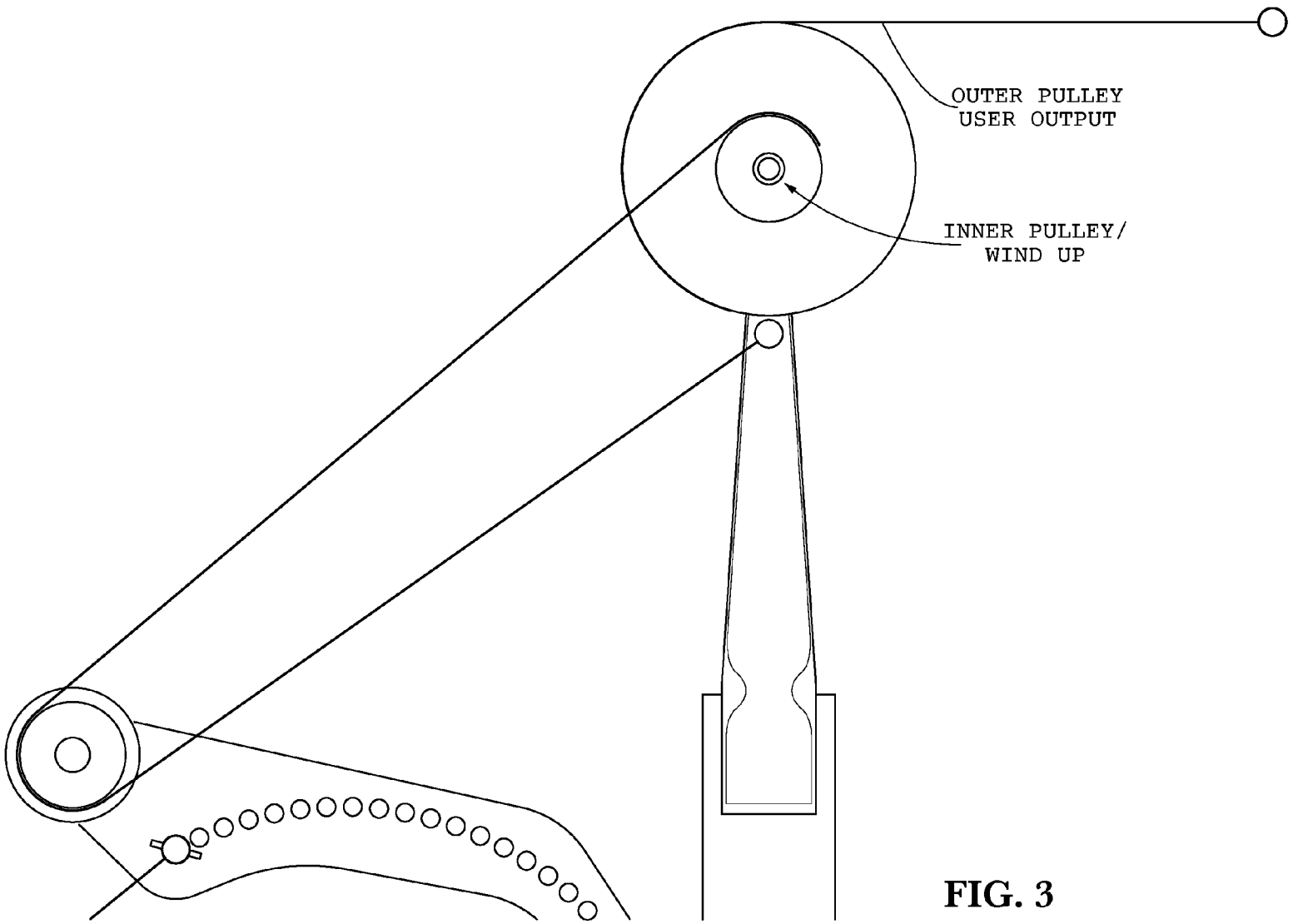
FIG. 3 is a detailed view of one embodiment for the gearing system for turning the large force from the resistive element into a usable load for resistive exercise.

Together with FIG. 1, FIGS. 2A-B through 4 provide teaching as to how the resistive arrangement operates in the disclosed embodiment. Directing attention first to the first rotational assembly 50, it is noted that the assembly is positioned at the second end 32, 32' of the respective second arms 26, 26'. A pin, shaft, or similar device 52 provides an axis of rotation for an assembly that has a pair of outer wheels 54, 54' with an inner wheel 56 (not visible in FIG. 1, but seen in FIGS. 2A-B and 3). Inner wheel 56 has a smaller radius than the outer wheels 54, 54', the latter wheels being preferably identical to each other. Preferably, all three wheels 54, 54', 56 are configured as sheaves. All three wheels 54, 54', 56 are also arranged for co-rotation about the axis defined by pin 52. This can be achieved by any of a variety of means, including attachment of the wheels 54, 54', 56 to each other and attachment of each wheel to the pin 52. Outer wheels 54, 54' are intended to receive a strap, cable, or other linear tension member (not shown), so that a user can impart rotation to the outer wheels. While the wheels of larger radius are referred to as "outer wheels", this is only reflective of the depicted embodiment, which is probably preferred, but the wheels could be arranged differently and still provide a functioning embodiment. In the preferred embodiment, the outer wheels are selected to have a radius greater than about 2 times the radius of the inner wheel, and, even more preferably, the wheel radius ratio is about 2.43 to 1.

The inner wheel 56 is a "roll-up" wheel. By this, it is meant that the inner wheel 56 is configured to have a first end of a belt or strap 62 attached to the wheel, so that rotation of the wheel causes the strap to either be rolled up onto the wheel or payed out from the wheel, depending on the direction of rotation. Belt or strap 62 is actually a part of second rotational assembly 60 and will be discussed below. This belt or strap 62, as well as the additional belts or straps that will be introduced, are selected to handle a strong tensile force. As a result, a webbed strap material such as, but not limited to a high-strength KEVLAR webbing may be exemplary of the material chosen.

Moving to second rotational assembly 60, it is noted that the assembly is positioned at the second end 42, 42' of the members 38, 38' of lever arm 36. A pin or similar device 64 provides an axis of rotation for an assembly which in this case has a single wheel 66, which acts as a classic pulley for the belt or strap 62. A second end of the belt or strap 62 is attached to the second arms 26, 26' at a fixed point 58, preferably just below the first rotational assembly 50. It will be understood from this that the rolling up or paying out of the strap 62 on inner wheel 56 causes the second end 42, 42' of lever arm 36 to move towards or away from the second end 30, 30' of first arm 24, 24'. Preferably, the second rotational assembly 60 is set up to provide an approximately 2 to 1 pulley effect.

A further feature of the second rotational assembly 60 is also noted before moving on to the third rotational assembly 70. The lever arm 36 has a plurality of holes 65 on each of the members 38, 38'. These holes 65 provide a plurality of locations for anchoring a belt or strap 72 that will be introduced below, as this belt or strap 72 is a part of the third rotational assembly 70.

The third rotational assembly 70 is now described. Strap 72 has already been mentioned. A first end of this strap 72 is fixed to one of the holes 65 with a pin or similar means 74. By selecting which hole 65 is used to place pin 74, the user can adjust the resistance load provided by the first rotational assembly 50 to the user. However, each hole 65 has been calculated such that the load profile outputted (force consistency vs. displacement) remains unchanged at different load settings. This results in a consistent (flat, linear) load profile at all set points. The second end of the strap 72 is fixed to a roll-up wheel 76 that is positioned between a pair of matching cam shaft pulleys 78, 78'. As in the first rotational assembly 50, the cam shaft pulleys 78, 78' are arranged on a cam shaft 79 for co-rotation with roll-up wheel 76 about an axis defined by the cam shaft or similar means. This can be achieved by any of a variety of means. When a user rotates outer wheels 54, 54' and effects movement of the lever arm 36 towards the second arms 26, 26', the belt or strap 72 is payed out from the roll-up wheel 76 by rotating the roll-up wheel. This causes both cam shaft pulleys 78, 78' to rotate.

Figure 6A:
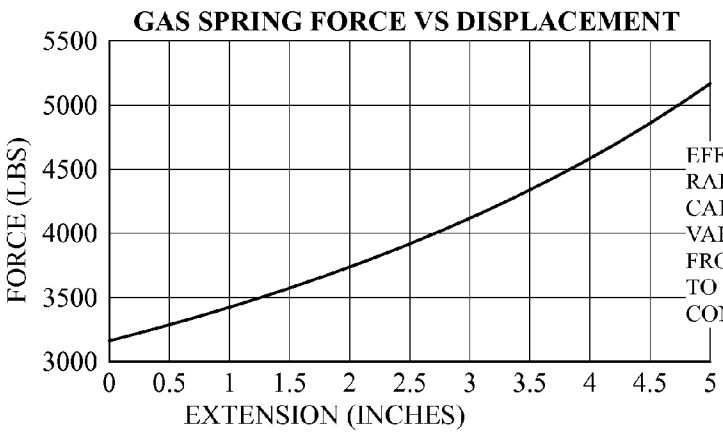
Figure 6B:
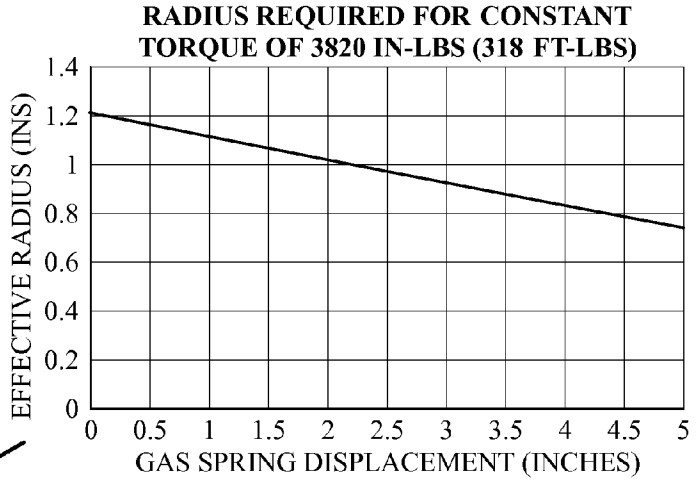
Figure 6C:
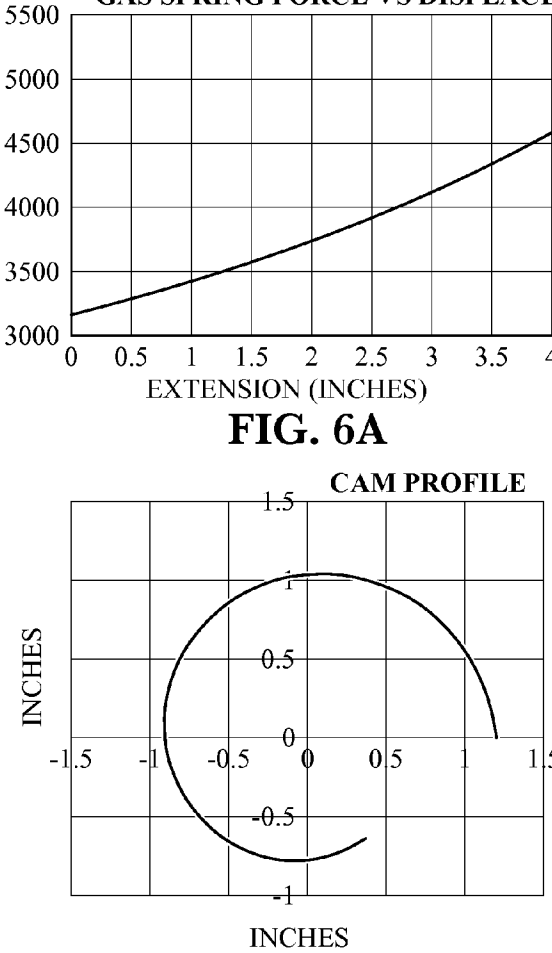

Finally, resistive element 80 is discussed. In the embodiment disclosed, and selected for its ability to provide a large resistance to a small displacement, is a high-pressure gas spring 82, however it should be noted that embodiments can utilize other types of resistive elements such as compression springs, hydraulic pressure cylinders, and tension springs. As an example, FIG. 6A shows a typical force v extension graph for a commercially-available gas spring 82. The gas spring 82 has a shaft 84 that can be compressed into a body 86. By affixing a linear tension means, such as a cord or strap 88 from the shaft 84 to a fixed position on each of the cam shaft pulleys 78, 78', the resistance of the gas spring 82 is converted into torque. Based upon the resistance curve in FIG. 6A, a chart, presented as FIG. 6B can be calculated to show the radius of the cam shaft pulley 78, 78' that is need to provide a constant torque. The calculated radii from FIG. 6B can then be used to generate a cam profile for the cam shaft pulleys 78, 78', as seen in FIG. 6C. Once this is implemented, and by using the preferred pulley ratios, etc., FIG. 6D can be generated to show that the interaction of system components results in a substantially constant output force over a range of displacement at the outer wheels 54, 54' from 0 meters to more than 1 meter.

Figure 6D:
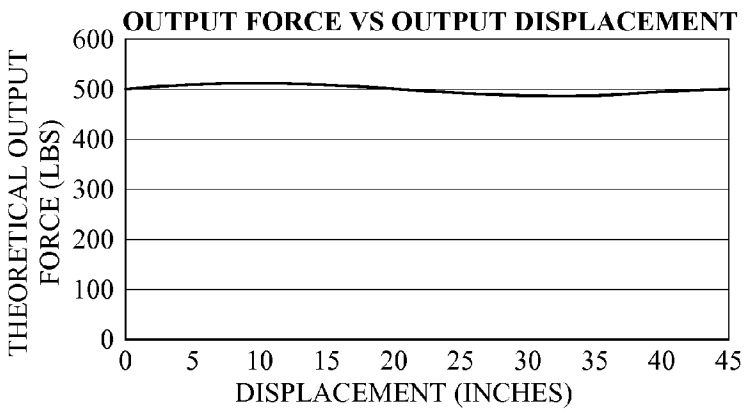

While the substantially constant output force in FIG. 6D is calculated for a theoretical maximum load of 500 lbs, it is notable that a similarly linear plot can be obtained at lesser loads, due to the arc pattern of the plurality of holes 65 on lever arm 36. The cam pulleys have been designed to create a near constant force. Using the features of the embodiment taught herein, the profile could be designed to create virtually any load profile. Unlike a cam/follower application of the prior art, the design uses the geometric circumference of the cam pulley spline pattern, not just the changing radius. This is because the cam pulley is wrapped with a strap in tension around a portion of the circumference instead of following the radius at a given contact point. The cam design is unique in that it does not follow plate, cylindrical or linear cam designs. The use of a strap wrapped around a cam profile in tension to linearize the force from a non-linear resistive component (i. e. a spring of some type) results in a novel approach for creating a consistent load for resistive exercise.

Figure 4:
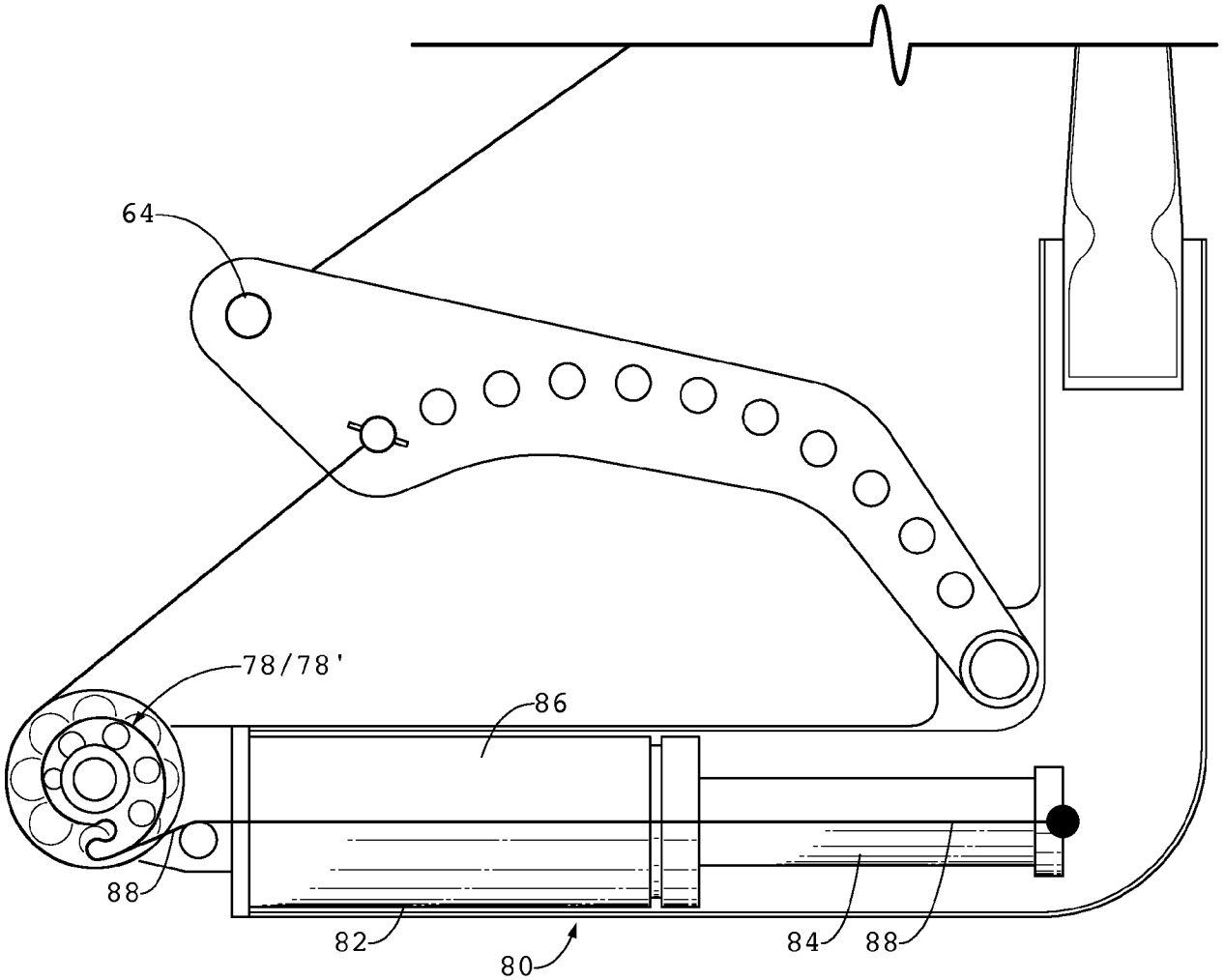
FIG. 4 is a side view of the resistive element and force adjustment system, showing the curved lever arm with a series of holes that allows the pin to move to different locations on the lever arm, changing the output force of the unit.

FIG. 4 shows a better view of the unique cam profile used to linearize the variable force from the gas spring 82 into a constant torque about the cam shaft 79. The gas spring is compressed by the strap attachment which is connected to the cam reels. By adjusting the distance between the lever arm pivot point and the strap attachment point, the load experienced by the user can be changed.

Figure 5:
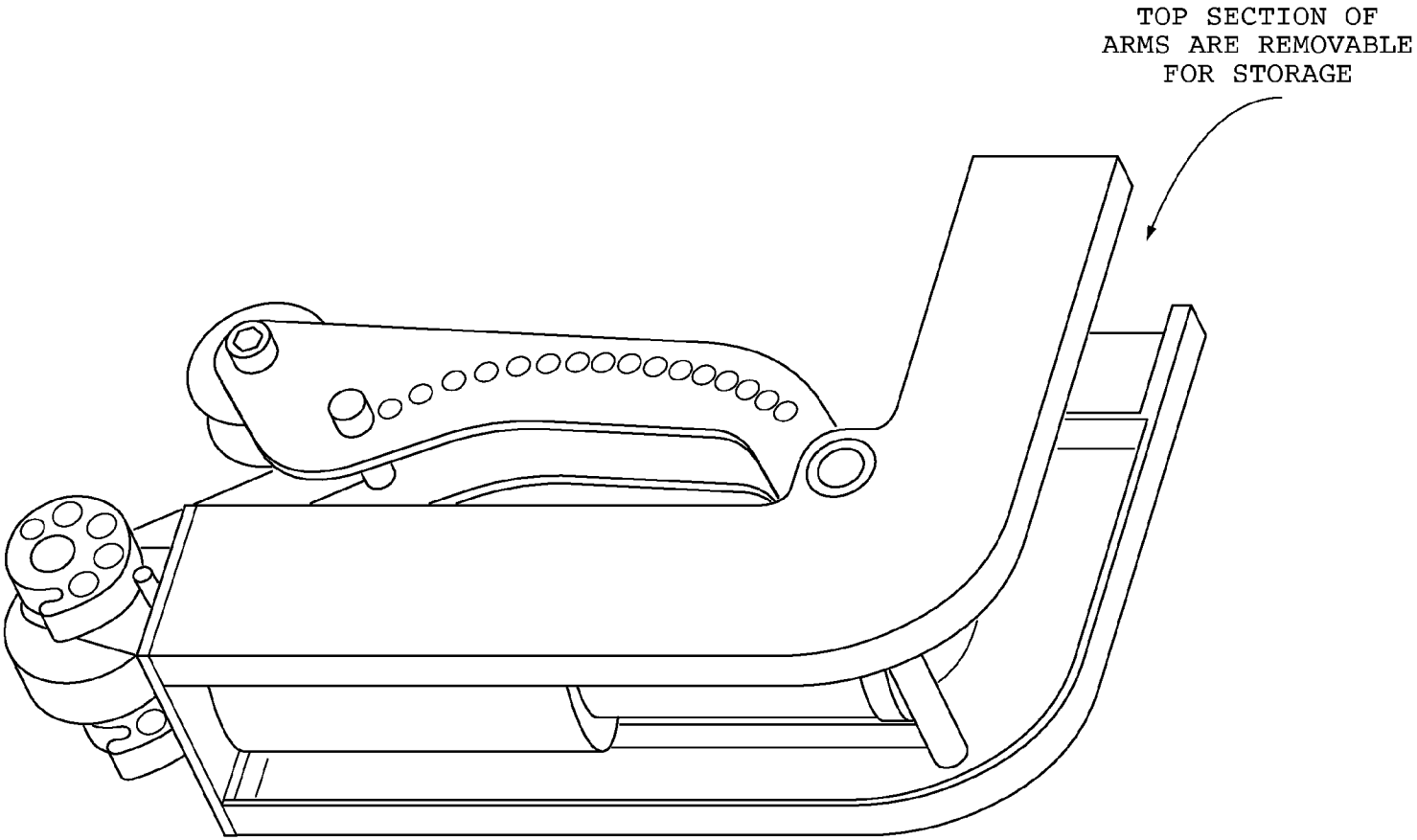
FIG. 5 is a perspective view of an exemplary embodiment of the device when disassembled for storage and FIGS. 6A through 6D are a series of graphs which demonstrate how the constant force is created from the variable force from a gas spring, as well as a force versus displacement curve at maximum load.

FIG. 5 shows a perspective view of an exemplary embodiment of the device when disassembled for storage. This embodiment of the device would simply need four bolts and subsequently the top arms to be removed to be small enough to be placed in a standard book bag.

It should be noted that while belts or straps have been shown in the exemplary embodiments herein, embodiments can be practiced with various elongate members, including but not limited to rope, wire, cables, and other members having circular cross sections.

Having shown and described a preferred embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

What is claimed is:

1. A device for providing exercise to a user, comprising:

a frame, comprising a first and a second arm, a first end of each arm meeting in fixed angular relationship at a vertex and a second end of each arm extending away from the vertex;

a lever arm, having a first and a second end, the first end constrained to rotate about a pin located near the vertex;

a resistance arrangement, configured to convert rotation by a user of a first rotational assembly about an axis on the second end of the first arm into rotation of a second rotational assembly about an axis on the second end of the lever arm, which is converted into rotation of a third rotational assembly about an axis on the second end of the second arm, with the rotation of the third rotational assembly being resisted by a resistive element, the resistance arrangement providing a substantially constant resistance against the rotation of the first rotational assembly;

wherein the frame comprises a first and a second member, the members being mirror images of each other and set in spaced apart relationship to each other;

wherein the resistive element comprises a gas spring, arranged in the frame between the first arms of the first and second frame members, the gas spring having an arm that is compressible into a cylinder; and wherein the first rotational assembly comprises:

a pair of outer wheels, each of which is adapted to receive a linear tension member by which the user imparts rotation thereto;

an inner wheel, arranged for co-rotation with the outer wheels; and a first rotational assembly pin, defining an axis of rotation for the pair of outer wheels and the inner wheel.

2. The exercise device of claim 1, wherein:

the lever arm comprising a first and a second lever arm member, the members being mirror images of each other and set in spaced apart relationship to each other.

3. The exercise device of claim 2, wherein:

the lever arm has a plurality of holes arranged in an arc along a length thereof, the holes providing a plurality of anchor points for adjusting an amount of a resistance of the resistance arrangement.

4. The exercise device of claim 1, wherein:

each outer wheel has a radius greater than about two times a radius of the inner wheel.

5. The exercise device of claim 1, wherein:

the second rotational assembly comprises:

a second rotational assembly pin, defining the axis of rotation about the second end of the lever arm;

a wheel, positioned on the pin for free rotation; and a first strap, a first end of which is attached to the inner wheel of the first rotational assembly and a second end of which is attached to the second arm of the frame, an intermediate portion of the strap passing around the wheel, so that the wheel and the first strap co-act as a pulley, so that rotation imparted by the user causes the first strap to either be rolled up onto the inner wheel or payed out therefrom, depending on the direction of rotation of the inner wheel.

6. The exercise device of claim 5, wherein:

the second rotational assembly is arranged to provide a pulley effect of two to one.

7. The exercise device of claim 5, wherein:

the third rotational assembly comprises:

a third rotational assembly pin, defining the axis of rotation about the second end of the second arm of the frame;

a roll-up wheel;

a second strap, a first end thereof fixed to the lever arm and a second end thereof is fixed to the roll-up wheel, such that movement of the lever arm away from the axis of rotation of the third rotational assembly pays out the second strap from the roll-up wheel; and a pair of identical cam shaft pulleys, arranged for co-rotation with the roll-up wheel about the axis of rotation of the third rotational assembly, each cam shaft pulley imposing torque on the roll-up wheel imposed by a set of third straps, each of the cam shaft pulleys having a first end of a corresponding one of the third straps attached thereto.

8. The exercise device of claim 7, wherein:

the set of identical cam shaft pulleys are designed to have a cam profile that linearizes the torque by the resistive element as the third straps are wrapped around the cam profile in tension.

9. A device for providing exercise to a user, comprising:

a resistive element where a force provided by the resistive element varies versus displacement of the resistive element;

a cam positioned on a cam shaft;

an elongate member having a pair of free ends and a length where one of the free ends is attached to the resistive element, the second free end is attached to the cam with a portion of the length wrapping around a portion of the cam such that when a user applies a force to the cam shaft the user sees a responding force from the cam shaft which does not vary substantially with displacement of the resistive element;

a frame, comprising a first and a second member, the members being mirror images of each other and set in fixed spaced apart relationship to each other, each member having a first and a second arm, a first end of each arm meeting in fixed angular relationship at a vertex and a second end of each arm extending away from the vertex;

a lever arm, having a first lever arm member and a second lever arm member, the lever arm members being mirror images of each other and set in fixed spaced apart relationship to each other, each lever arm member having a first and a second end, the respective first ends constrained to rotate about a vertex in located near the vertex;

a first rotational assembly, comprising an outer wheel adapted to receive a linear tension member by which the user imparts rotation thereto, an inner wheel, arranged for co-rotation with the outer wheel, and a first rotational assembly pin, defining an axis of rotation for the outer wheel and the inner wheel;

a second rotational assembly; an axis of rotation of which is located near the second end of the lever arm, the second rotational assembly having a second rotational assembly pin that defines the axis of rotation of the second rotational assembly, which is arranged as a pulley with a rolling wheel and a strap, a first end of the strap attached to the inner wheel of the first rotational assembly, a second end of the first strap attached to the second arm of the frame, and an intermediate portion of the first strap passing around the rolling wheel, so that rotation imparted by the user causes the first strap to either be rolled UP onto the inner wheel or payed out therefrom, depending on the direction of rotation;

a roll up wheel fixed to the cam shaft; and an elongate member having a first end attached to the lever arm and a second end attached to the roll up wheel on the cam shaft.

10. The exercise device of claim 9 wherein:

the user applies a force to the cam shaft by applying a rotational force to a roll up wheel which causes displacement of a rolling wheel, whereby said displacement of the rolling wheel is resisted by the cam shaft.

11. A device for providing exercise to a user, comprising:

a frame, comprising a first and a second member, the members being mirror images of each other and set in fixed spaced apart relationship to each other, each member having a first and a second arm, a first end of each arm meeting in fixed angular relationship at a vertex and a second end of each arm extending away from the vertex;

a lever arm, having a first lever arm member and a second lever arm member, the members being mirror images of each other and set in fixed spaced apart relationship to each other, each lever arm member having a first and a second end, the respective first ends constrained to rotate about a vertex pin located near the vertex; and a resistance arrangement, comprising:

a first rotational assembly, comprising a pair of outer wheels, each of which is adapted to receive a linear tension member by which the user imparts rotation thereto, an inner wheel, arranged for co-rotation with the outer wheels, and a first rotational assembly pin, defining an axis of rotation for the pair of outer wheels and the inner wheel, the axis of rotation of the first rotational assembly located near the second ends of the first arms of the frame;

a second rotational assembly; an axis of rotation of which is located near the second end of the lever arm, the second rotational assembly having a second rotational assembly pin that defines the axis of rotation of the second rotational assembly, which is arranged as a pulley with a wheel and a first strap, a first end of the first strap attached to the inner wheel of the first rotational assembly, a second end of the first strap attached to the second arm of the frame, and an intermediate portion of the first strap passing around the wheel, so that rotation imparted by the user causes the first strap to either be rolled up onto the inner wheel or payed out therefrom, depending on the direction of rotation of the inner wheel;

a third rotational assembly, comprising a third rotational assembly pin, defining an axis of rotation of the third rotational assembly, the axis of rotation located near the second end of the second arm of the frame, a roll-up wheel and a pair of identical cam shaft pulleys arranged for co-rotation on the third rotational assembly pin, a second strap, a first end of which is fixed to the lever arm and a second end thereof is fixed to the roll-up wheel, such that movement of the lever arm away from the axis of rotation of the third rotational assembly pays out the second strap from the roll-up wheel, a set of third straps, a first end of each of the third straps attached for roll-up or pay-out from a corresponding one of the pair of identical cam shaft pulleys; such that each of the cam shaft pulleys imposes torque on the roll-up wheel to maintain the second strap in a rolled-up condition; and a resistive element, comprising a gas spring, arranged in the frame between the first arms of the first and second frame members, the gas spring having an arm that is compressible into a cylinder, the second ends of the third straps attached to the arm.

* * * * *